United States Patent [19]

Lieberum et al.

[11] Patent Number: 4,957,028

[45] Date of Patent: Sep. 18, 1990

[54] RAMMER FOR ARTILLERY SHELLS

[75] Inventors: Karl Lieberum, Niedenstein; Werner Hofmeister, Reinhardshagen; Peter Grunewald, Fuldabruck, all of Fed. Rep. of Germany

[73] Assignee: Firma Wegmann & Co. GmbH, Kassel, Fed. Rep. of Germany

[21] Appl. No.: 380,928

[22] Filed: Jul. 14, 1989

[30] Foreign Application Priority Data

Jul. 28, 1988 [DE] Fed. Rep. of Germany ..... 3825662

[51] Int. Cl.[5] ..... F41A 9/44

[52] U.S. Cl. ..... 89/47

[58] Field of Search ..... 89/45, 46, 47, 36.08

[56] References Cited

U.S. PATENT DOCUMENTS

| | | | |
|---|---|---|---|
| 789,885 | 5/1905 | Schneider . | |
| 3,584,532 | 6/1971 | Stoner | 89/47 |
| 4,291,611 | 9/1981 | Wells et al. | 89/47 |
| 4,754,688 | 7/1988 | Abels | 89/47 |

FOREIGN PATENT DOCUMENTS

| | | | |
|---|---|---|---|
| 335895 | 10/1930 | United Kingdom | 89/45 |
| 2065845 | 7/1981 | United Kingdom | 89/47 |

*Primary Examiner*—Charles T. Jordan
*Assistant Examiner*—Stephen Johnson
*Attorney, Agent, or Firm*—Sprung Horn Kramer & Woods

[57] ABSTRACT

A rammer for artillery shells with a carriage behind the gun's tube that supports a tray in alignment with the powder chamber, that has a mechanism at the rear to intercept the shell, that travels on slides along a track paralleling the axis R of the tube, that is coupled to a piston-and-cylinder drive mechanism to accelerate toward the tube, and that has a braking mechanism to brake it at a prescribed distance from the rear end of the tube. The braking mechanism has a shock absorber position in the longitudinal midplane of the carriage with a piston that moves against the force of a friction spring inside a cylinder and that has a piston rod projecting forward beyond the front of the carriage with a stop mounted on it, whereby the stop rests directly against the rear end of the tube when the carriage is in the forward and braked position.

7 Claims, 5 Drawing Sheets

RAMMER FOR ARTILLERY SHELLS

BACKGROUND OF THE INVENTION

The invention concerns a rammer for artillery shells with a carriage behind the gun's tube that supports a tray in alignment with the powder chamber, that has a mechanism at the rear to intercept the shell, that travels on slides along a track paralleling the axis of the tube, that is coupled to a piston-and-cylinder drive mechanism to accelerate toward the tube, and that has a braking mechanism to brake it at a prescribed distance from the rear end of the tube.

In loading artillery shells, the projectile, which weighs 50 kg or more, must be thrust far enough into the tube at least 1.5 m/sec to force the soft-metal guide ring on the shell into the conical section of the powder chamber. The force must be powerful enough to prevent the shell from falling out subject to its own weight even when the tube is at maximum elevation and simultaneously to weal off the front of the powder chamber.

Since manual ramming by the gun crew takes time and is very tiring, mechanical rammers of various types have been developed.

Especially significant are what are called free-flight rammers that operate on the principle of accelerating the projectile to such an extent while it is still outside the gun that, once it has left the accelerating system, its momentum will carry it forward unsupported. A free-flight rammer of this type is described in U.S. Pat. No. 4,754,688 for example.

Also known is a free-flight rammer with the aforesaid characteristics wherein the shell resting on the carriage is accelerated along with the carriage, which is braked once the requisite ramming speed has been attained. The shell then flies on through the breech plate and powder chamber and rams into the grooves in the tube. The carriage is powered with a pneumatic or hydraulic piston-and-cylinder drive mechanism.

Two problems occur with free-flight rammers of this type. First, the carriage-plus-shell system must be powerfully accelerated to attain the maximum ramming speed. Second, the direction that the shell travels in when the carriage is braked must be very precisely aligned with the axis of the tube so that it will not scrape against the walls of the breech plate and powder chamber as it travels through them, which would damage either the shell or the gun. Since the tolerance is usually only a few millimeters, care must be taken to ensure that no interfering forces occur when the carriage is braked that would add moments to the rammer and deflect the shell from its alignment with the axis of the tube.

SUMMARY OF THE INVENTION

The object of the present invention is to improve a rammer of the aforesaid type to the extent that no interfering forces will occur when the carriage is braked and have a detrimental effect on the shell while it is being rammed.

This object is attained in accordance with the invention by the improvement wherein the braking mechanism has a shock absorber positioned in the longitudinal midplane of the carriage with a piston that moves against the force of a friction spring inside a cylinder and that has a piston rod projecting forward beyond the front of the carriage with a stop mounted on it, whereby the stop rests directly against the rear end of the tube when the carriage is in the forward and braked position.

It is of advantage in this embodiment for the central axis of the shock absorber to extend at least approximately through the carriage's center of mass.

It is also of advantage for the carriage to have longitudinal guide rails that position the shell and for the shell-accommodation mechanism to engage at the rear of the carriage and above the central axis of the shell.

The friction spring in this embodiment should transmit at least $\frac{2}{3}$ of the kinetic energy of the braking carriage by way of friction, with the remaining energy being exploited to return the carriage to its starting position, where the excess energy is absorbed by another shock absorber.

If the rammer's piston-and-cylinder drive mechanism is pneumatic, the drive mechanism can constitute the second shock absorber, and its propellant gas can be exhausted through a choke valve when the carriage travels back to its starting position.

If, again, the piston-and-cylinder drive mechanism is pneumatic, the drive mechanism's connecting line can be switched by way of a rapid-opening control valve to either a compressed-air reservoir or an outlet, with the piston-return connection communicating with another outlet by way of a rapid-exhaust valve.

The piston-return connection can be switched by way of another control valve to either an outlet or the compressed-air reservoir.

The choke valve can be accommodated in the outlet from the first control valve.

As will be described in greater detail hereinafter, the basic principle of the invention is to brake the carriage by letting it strike the rear end of the weapon's tube through an intermediate shock absorber. The result is that the very large mass of the tube will prevent the carriage from tilting as it brakes, as it would if it were braked by stops on the track that the carriage travels along or on the drive mechanism. The intermediate shock absorber is positioned at the longitudinal midplane of the carriage and preferably extends at least approximately through the carriage's center of mass, which additionally ensures that no interfering moments will occur during the braking procedure. The longitudinal guide rails that position the shell and the shell-accommodation mechanism that engages at the rear of the carriage and above the central axis of the shell prevent the point of the shell from tilting up when it leaves the carriage. Even different types of shell will accordingly remain absolutely stable while being accelerated.

Since the shock absorber absorbs only a certain fraction of the braking shell's kinetic energy, the rest of the energy can be exploited to return the carriage to its starting position, with any excess energy being absorbed by another shock absorber that can be integrated into the drive mechanism.

The carriage is preferably driven by a pneumatic system with the air that operates the piston-and-cylinder drive mechanism stored in a reservoir and suddenly supplied to the mechanism by way of a rapid-opening control valve.

BRIEF DESCRIPTION OF THE DRAWINGS

One embodiment of a rammer for artillery shells in accordance with the invention will now be described in detail with reference to the drawings, wherein.

DETAILED DESCRIPTION OF THE INVENTION

Figure 1:
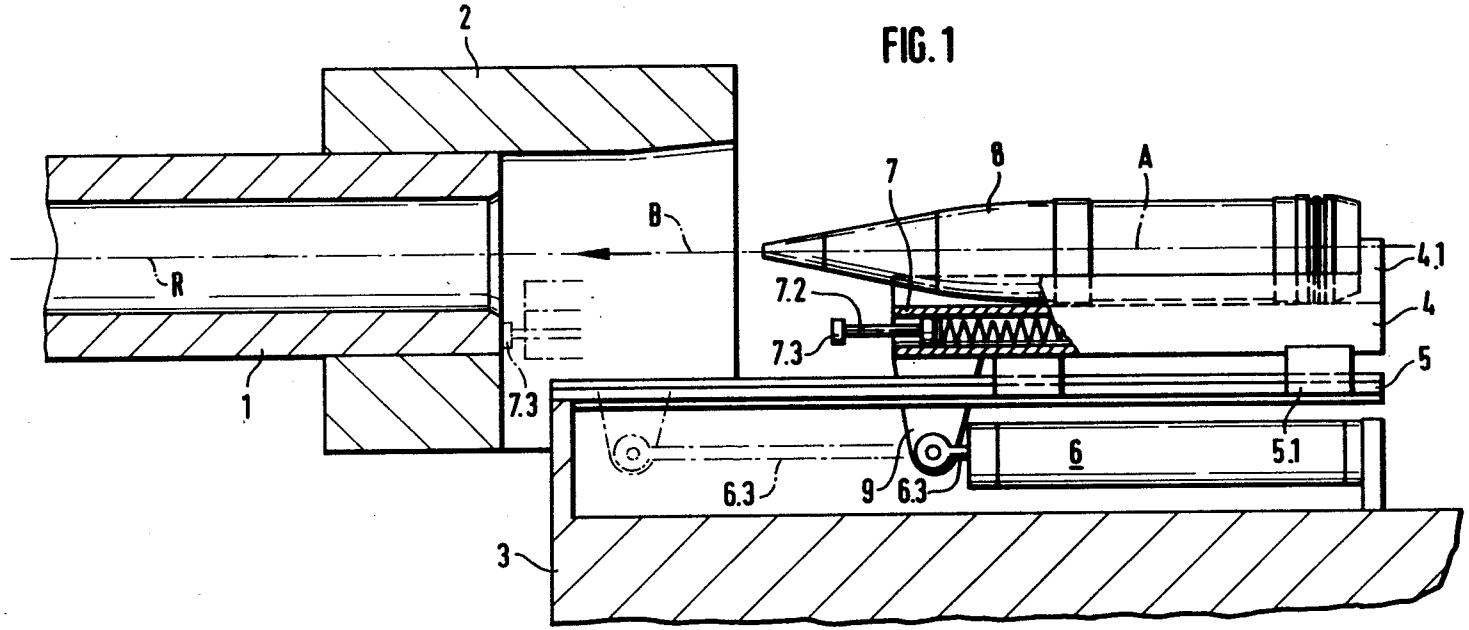
FIG. 1 is a highly schematic longitudinal section of the rear of a gun's tube with a rammer mounted in it.
Figure 2:
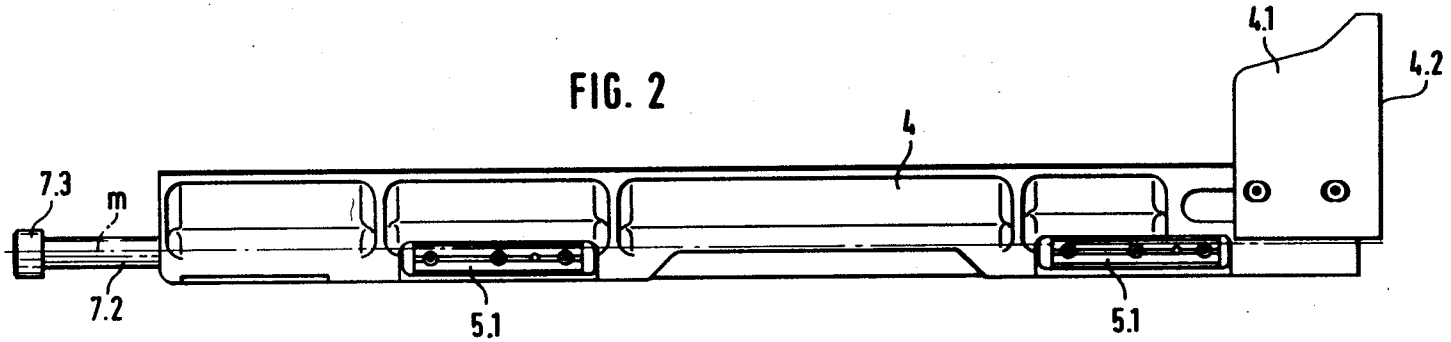
FIG. 2 is a side view of the carriage for the rammer illustrated in FIG. 1.
Figure 3:
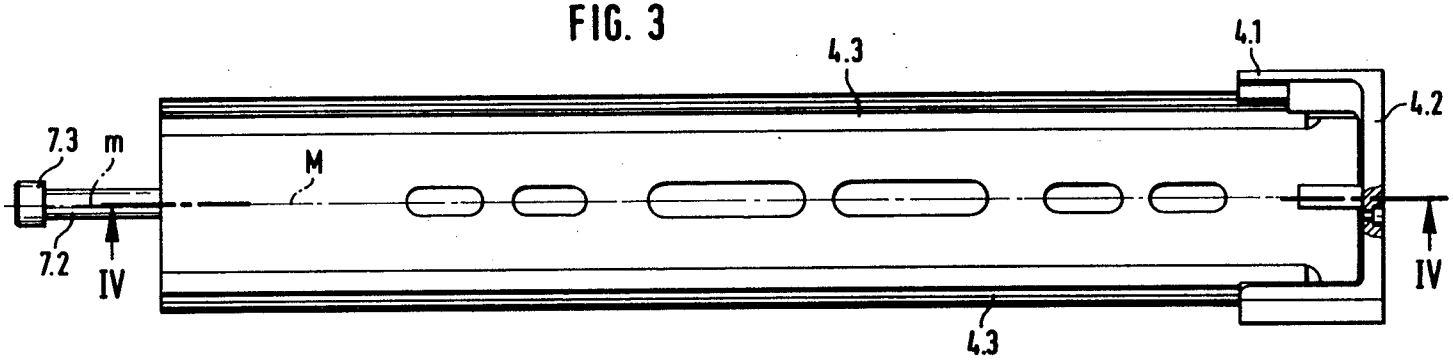
FIG. 3 is a top view of the carriage from FIG. 1.
Figure 4:
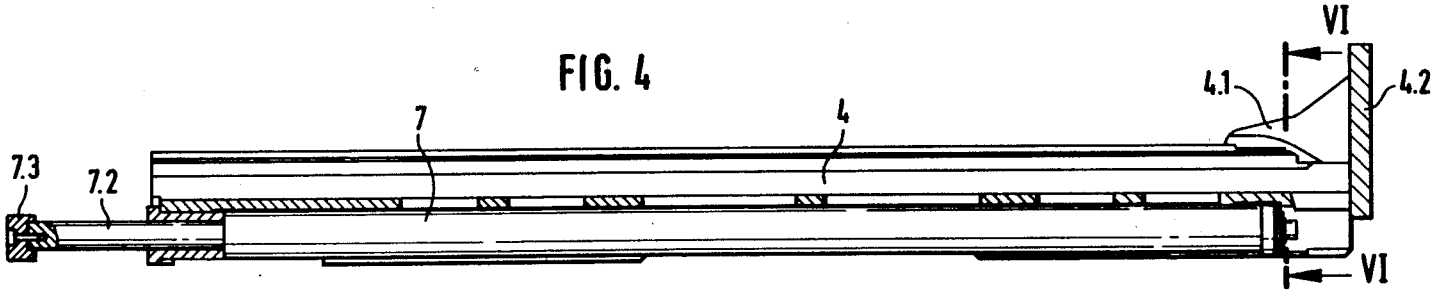
FIG. 4 is a section along the line IV—IV in FIG. 3.

FIG. 1 illustrates the rear of the tube 1 of an otherwise unillustrated gun with a breech plate 2. Positioned behind tube 1 is a rammer with a base 3. Secured to the base is a track 5, along which a carriage 4 travels on slides 5.1 paralleling the axis R of tube 1. Carriage 4 is coupled by way of an extension 9 to a piston-and-cylinder drive mechanism 6 that can accelerate it in the direction indicated by arrow B. Positioned along carriage 4 is a shock absorber 7, which will be described in greater detail hereinafter. The shock absorber has a piston rod 7.2 that extends forward out of carriage 4. The piston rod has a stop 7.3. The shell 8 that is to be rammed rests longitudinally on carriage 4 on guide rails 4.3 (FIG. 3). The carriage 4 and shell 89 illustrated in FIG. 1 are in the starting position, before the initiation of acceleration. The forwardmost positions of carriage 4, of the piston rod 6.3 on piston-and-cylinder drive mechanism 6, and of the stop 7.3 on shock absorber 7 are represented by broken lines. As will be evident from FIG. 1, stop 7.3 is directly against the rear of the tube when carriage 4 is in its forwardmost position.

FIGS. 2 through 6 illustrate the structure of the carriage in greater detail. Shock absorber 7 is mounted on the longitudinal midplane M of carriage 4 with its central axis extending in a way that is not specifically characterized through the carriage's center of mass.

Figure 5:
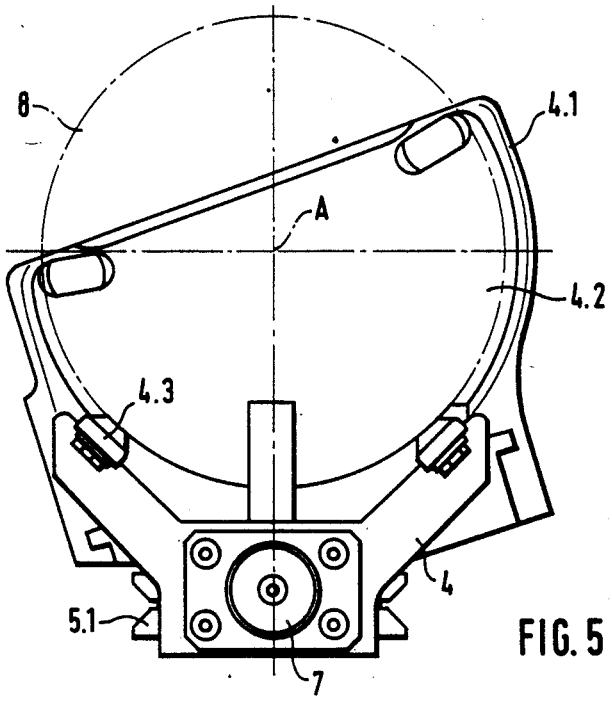
FIG. 5 is a front view of the carriage illustrated in FIGS. 2 through 4.
Figure 6:
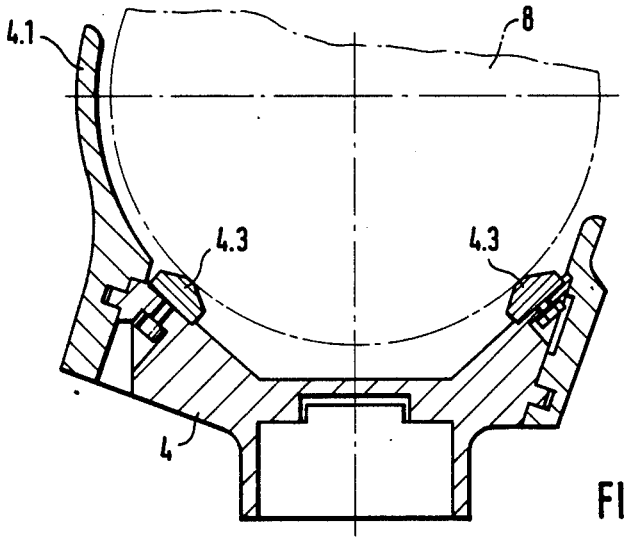
FIG. 6 is a slightly larger-scale section along the line VI—VI in FIG. 4.

At the rear of carriage 4 is a tray-like shell-accommodation mechanism 4.1 that is, as will be evident from FIGS. 5 and 6, asymmetrical to the longitudinal midplane of the carriage in that a shell 8 is laid on it from the side. The upper edge of the rear wall 4.2 of shell-accommodation mechanism 4.1 extends such that the accommodation point is above the central axis A of a shell 8 resting on guide rails 4.3.

Figure 7:
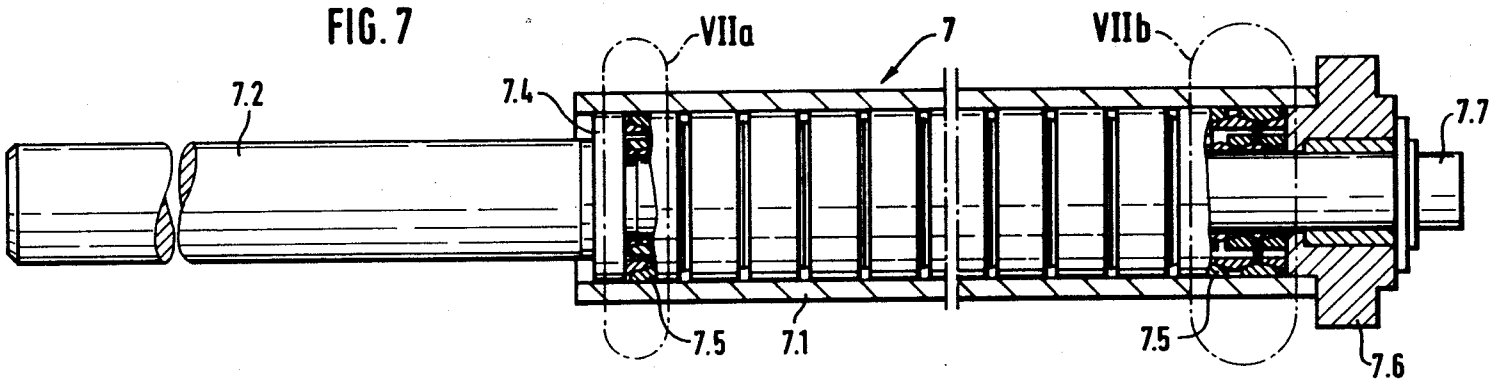
FIG. 7 is a section through a shock absorber for the carriage illustrated in FIGS. 2 through 6.
Figure 7B:
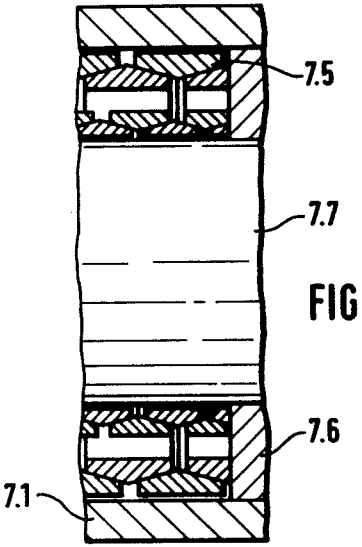
FIGS. 7*a* and 7*b* are details of the areas VII*a* and VII*b* of the shock absorber illustrated in FIG. 7.
Figure 7A:
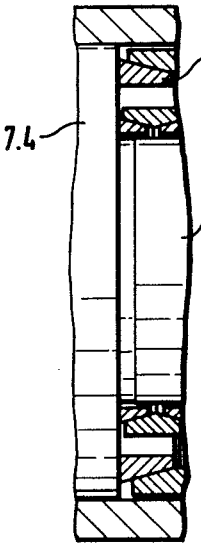

FIG. 7 illustrates the structure of shock absorber 7 in greater detail. The shock absorber has a cylinder 7.1 that accommodates a piston 7.4 with a piston rod 7.2. At the outer end of the rod and not illustrated in FIG. 7 is stop 7.3. Piston rod 7.2 is rigidly secured to piston 7.4 and to a tie rod 7.7, which guides it through a holder 7.6 during the piston's return stroke. Between tie rod 7.7 and the inner surface of cylinder 7.1 is a friction spring 7.5. Friction springs of this type are generally known, and their structure can be derived from FIGS. 7*a* and 7*b*, which illustrate areas at each end of the spring. Friction spring 7.5 comprises several closed inner and outer rings. The inner surface of the outer rings and the outer surface of the inner rings are conical, and the rings rest on those surfaces. When the cylinder constituted of the inner and outer rings is subjected to axial force, the conical surfaces slide together, with the outer rings expanding and the inner rings contracting in diameter. Since the rings are made of spring steel, sufficiently high forces will generate a resilient upsetting process, and the particular characteristic of this spring is the powerful frictional attenuation that results from the friction between the outer and inner rings. Approximately $\frac{2}{3}$ of the induced energy is accordingly converted into frictional heat.

A shock absorber of this type is of particular advantage for the rammer described herein in that the majority of the kinetic energy available when the carriage arrives in the braked position is converted, with the rest accessible for restoring the carriage to its starting position. It is of course also possible to employ a shock absorber that absorbs all of the braking carriage's kinetic energy and to return the carriage to its starting position with the drive system. Piston-and-cylinder drive mechanism 6 can in principle be either hydraulic or pneumatic.

Figure 8:
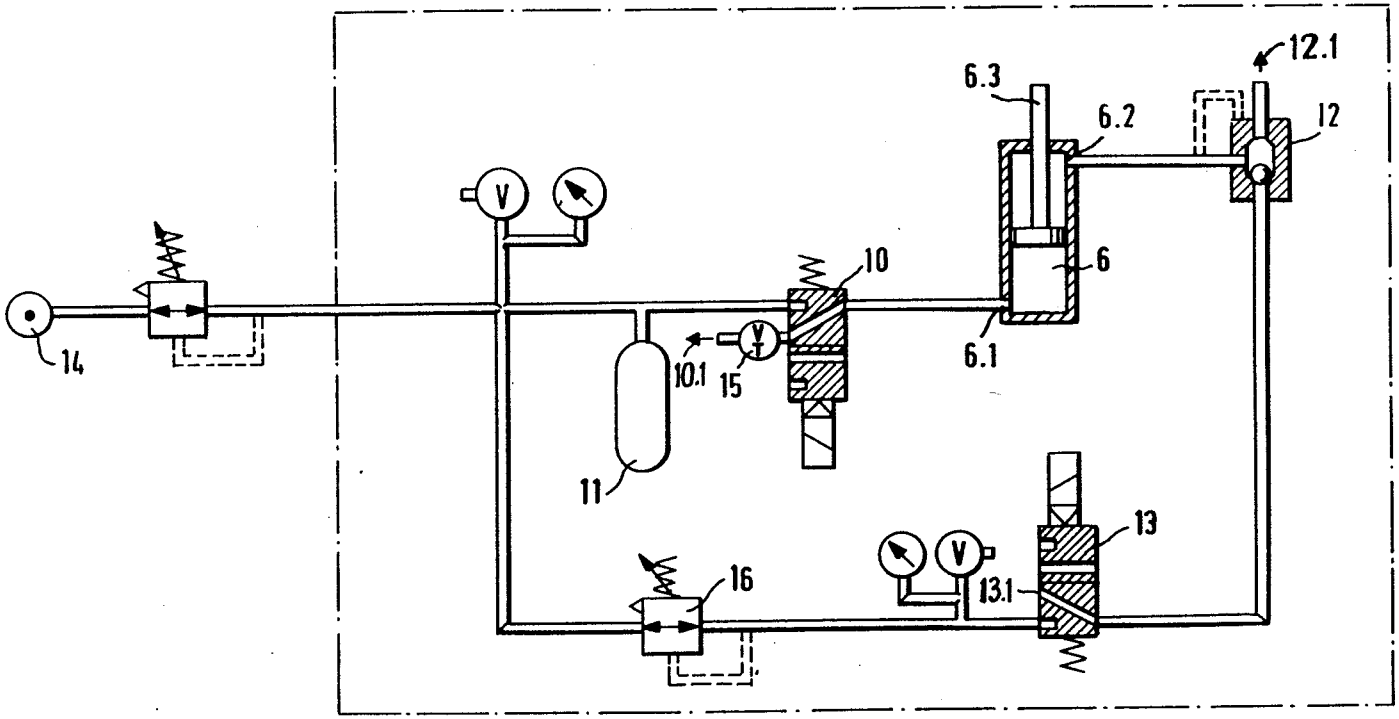
FIG. 8 is a diagram of pneumatic controls for the rammer illustrated in FIGS. 1 through 7.

A pneumatic drive mechanism with the controls illustrated in FIG. 8 is especially advantageous.

The connecting line 6.1 associated with the piston-and-cylinder drive mechanism 6 in the pneumatic system illustrated in FIG. 8 can be switched by way of an electromagnetic control valve 10 between an outlet 10.1 and a compressed-air reservoir 11. The reservoir communicates conventionally with a source 14 of compressed air. The drive mechanism's piston-return connection 6.2 can be switched to an outlet 12.1 by way of a rapid-exhaust valve 12 and by way of another electromagnetically operated control valve 13 with an intermediate pressure-limiting mechanism either to compressed-air reservoir 11 or to another outlet 13.1. Control valve 10 is a rapid-opening type distinguished for its short response time, making it possible to deliver the requisite volumetric flow of air to piston-and-cylinder drive mechanism 6 very rapidly. Thus, when the accelerate process is initiated, a sudden pressure of 30 bars for example will be available to force the piston forward and accelerate the carriage. The column of air on the other side of the piston will simultaneously be expelled through rapid-exhaust valve 12. Carriage 4 is braked upon termination of the accelerate stroke, with $\frac{2}{3}$ of its kinetic energy being converted as previously described herein and with the remainder available to generate a force that returns the carriage to its starting position. During the corresponding motion of the piston in drive mechanism 6, the air is conveyed by way of connecting line 6.1 and the correspondingly shifted control valve 10 through choke valve 15. Piston-and-cylinder drive mechanism 6 is accordingly now acting as a shock absorber that converts the residual energy. It is, however, also possible to return carriage 4 by connecting piston-return connection 6.2 to compressed-air reservoir 11 by way of second control valve 13 and a pressure limiter 16, supplying the drive mechanism with a lower pressure, of 7 bars for example, for returning the carriage to its starting position. This procedure will restore the carriage to a prescribed limiting position.

It will be appreciated that the instant specification and claims are set forth by way of illustration and not limitation, and that various modifications and changes may be made without departing from the spirit and scope of the present invention.

What is claimed is:

1. A rammer for artillery shells having a carriage behind a gun tube for supporting a tray in alignment with a powder chamber, means disposed at a rear end of the tray to intercept a shell of the artillery shells, means mounting the rammer for movement on slides along a track paralleling an axis of the tube, a piston-and-cylinder drive mechanism coupled to the rammer to accelerate same toward the tube, and braking means to brake the rammer at a prescribed distance from a rear end of the tube, wherein the braking means has a shock absorber positioned in a longitudinal midplane of the carriage comprising a cylinder with a friction spring therein and a piston in the cylinder that moves against a force of the friction spring inside the cylinder and having a piston rod projecting forward from the cylinder beyond a front portion of the carriage with a stop mounted on the piston rod and resting directly against said rear end of the tube when the carriage is in a forward and braked position, wherein the friction spring converts at least $\frac{2}{3}$ of the kinetic energy of the carriage by way of friction into heat, with a remaining $\frac{1}{3}$ of the kinetic energy used to return the carriage to its starting position and another shock absorber for absorbing any excess energy.

2. The rammer as in claim 1, wherein a central axis of the shock absorber extends at least approximately through the carriage's center of mass.

3. The rammer as in claim 1, wherein the carriage has longitudinal guide rails for guiding the shell and wherein the intercepting means disposed at the rear end of the tray comprises a shell-accommodation mechanism for engaging the shell above a central axis of the shell.

4. The rammer as in claim 1 a, wherein said another shock absorber comprises a pneumatic piston-and-cylinder drive mechanism having a propellant gas exhausted through a chock valve when the carriage travels back to a starting position.

5. The rammer as in claim 4, wherein the pneumatic piston-and-cylinder drive mechanism has a connection line and a rapid-opening control valve for alternatively connecting same to a compressed-air reservoir and an outlet, and a piston-return connection communicating with another outlet by a rapid-exhaust valve.

6. The rammer as in claim 5, further comprising another control valve for alternatively switching the piston-return connection to an outlet and the compressed-air reservoir.

7. The rammer as in claim 5, further comprising a choke valve accommodated in the outlet from the rapid-opening control valve.

* * * * *